United States Patent [19]

Cheng

[11] Patent Number: 4,867,577

[45] Date of Patent: Sep. 19, 1989

[54] DECORATIVE GIFT PACKAGE

[76] Inventor: Peter S. C. Cheng, 5 Ross Street, Toronto, Ontario, Canada, M5T 1Z8

[21] Appl. No.: 95,910

[22] Filed: Sep. 14, 1987

[51] Int. Cl.[4] ..... B65D 33/16

[52] U.S. Cl. ..... 383/78; 383/8; 383/72; 229/922

[58] Field of Search ..... 383/6, 8, 21, 29, 72, 383/84, 78; 229/922, 8

[56] References Cited

U.S. PATENT DOCUMENTS 2,722,367 11/1955 Verlin ..... 383/6
4,201,331 5/1980 Austin ..... 229/922

FOREIGN PATENT DOCUMENTS 295931 5/1965 Netherlands ..... 383/72

*Primary Examiner*—Willis Little
*Attorney, Agent, or Firm*—Kirschstein, Kischstein, Ottinger & Israel

[57] ABSTRACT

A gift package is adorned with an integral self-forming bow movable from a bow-unformed position to a bow-formed position by a pull-type or folding-type actuator to which the bow is operatively connected. The actuator may be integral with an article such as a shopping bag to be decorated, or the actuator and the bow may be formed as a discrete assembly which is separately attached to the article, or the bow may be integral with the article.

29 Claims, 3 Drawing Sheets

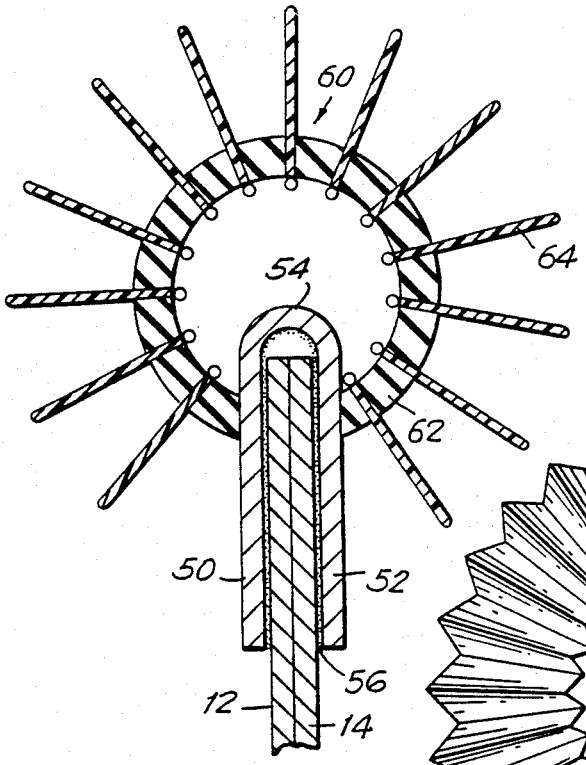
FIG. 6
FIG. 5
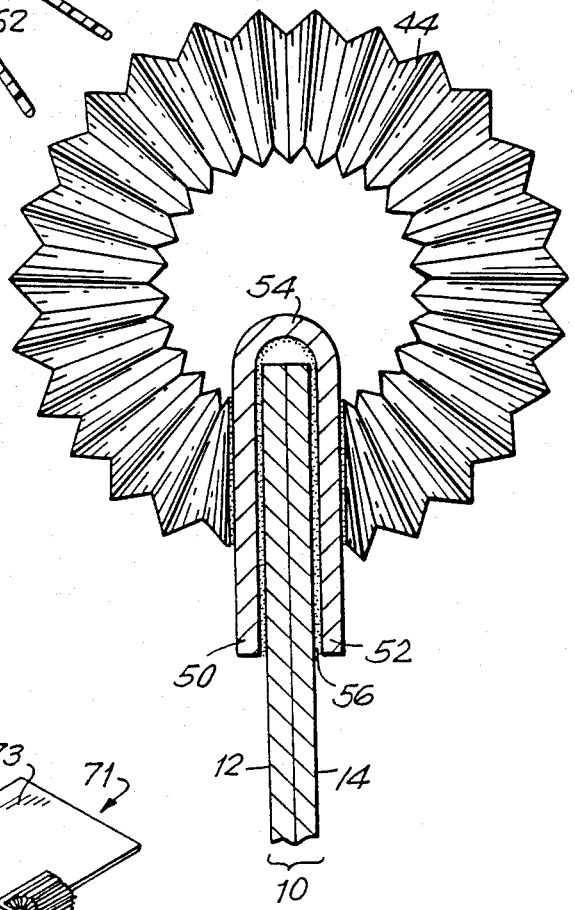
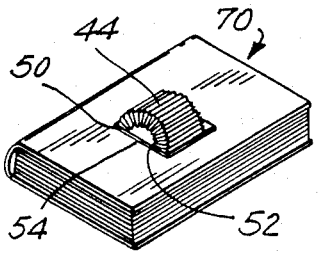
FIG. 7
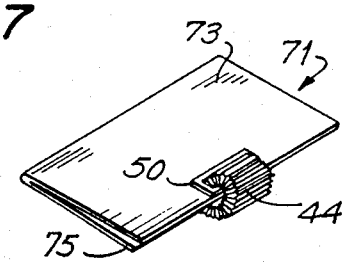
FIG. 8

DECORATIVE GIFT PACKAGE

BACKGROUND OF THE INVENTION

1. Field of the Invention

This invention generally relates to a decorative gift package for decorating many types of articles and, more particularly, to a shopping bag integrated with a self-forming bow which, when formed, closes the bag and completes a gift-receiving package.

2. Description of Related Art

A wide variety of gift wrapping and packaging materials is available to a gift giver. Separate bows and wrapping paper are conventionally used to adorn a gift package. Although the wrapping procedure is simple enough in theory, nevertheless, experience has shown that a certain amount of skill is indeed necessary to properly wrap a package. Indeed, for this purpose, department stores regularly employ skilled personnel in wrapping departments, and skilled individuals hire out their wrapping talents within shopping malls, particularly at holiday seasons.

In order to simplify the wrapping procedure, a bow may be pre-formed and pasted onto a wrapped package, or a separate bow may be formed in situ on the package by pulling on a drawstring, thereby folding individual bow-forming ribbons into loops which together are stacked to form a bow. See, for example, U.S. Pat. Nos. 3,632,464 and 2,562,919. Even so, a need exists for a ready-to-go package which can be formed without any specific skills or talent into a decoratively wrapped package so that gifts or like objects can be attractively presented with a minimum of fuss and bother.

There also exists a need for such a gift package which, in its unformed or unerected condition, lies flat for ease of storage, shipment and display, and which occupies a minimum of space.

In earlier efforts to integrate a package and a bow in a unitary combination, as described, for example, in U.S. Pat. Nos. 4,608,283 and 4,566,592, the bow was formed at one side of the package. However, such gift presentations were only attractive when viewed from the side adorned by the bow. The opposite side of the package was plain by comparison.

In addition, the known integrated package and bow combinations were not tamper-resistant in the sense that they were readily openable and re-usable. Many retailers, in an effort to prevent shoplifting, after a customer has paid for an article placed within an always-open shopping bag, would like to prevent the customer from placing additional unpaid-for articles within the bag. Retailers have resorted to folding or otherwise gathering upper marginal edge regions of the bag and, thereupon, stapling the so-folded or gathered regions to close the bag. Paper bag seals, such as taught by U.S. Pat. No. 1,128,192, have also been disclosed to close the bag and prevent items from being subsequently placed therein. However, the need persists for a bag which is not only effectively closed to deter theft, but also which is attractive as viewed from all sides of the bag.

SUMMARY OF THE INVENTION

1. Objects of the Invention

It is a general object of this invention to provide a ready-to-form decorative gift package.

It is another object of this invention to provide an integrated, novel package and bow combination which can be rapidly formed with a minimum of fuss and bother by unskilled personnel.

Still another object of this invention is to simultaneously close a package and adorn it with a bow which is visible from all sides of the package.

A further object of this invention is to effectively seal a package and prevent its re-use.

Another object of this invention is to provide a compact, integrated bag and bow combination which lies generally flat in the unformed or unerected condition for ease of storage, shipment and display.

2. Features of the Invention

In keeping with these objects, and others which will become apparent hereinafter, one feature of this invention resides, briefly stated, in a decorative gift package, which comprises an article, and means on the article for forming a decorative bow visible from all sides of the article.

In the exemplary case where the article is a container, e.g. a bag in which a gift object is received, the container has walls, e.g. a front and a rear wall, which oppose each other. The front and rear walls are movable away from each other to bound an upper opening through which the object may pass, and are also movable toward each other to close the opening. In a preferred embodiment, a paper or synthetic plastic material shopping bag having two carrying bails, one on each of the front and rear walls, is employed. Upon formation of the bow, the upper opening is simultaneously closed. The bow extends above the closed opening and is visible from all sides of the bag.

The forming means includes actuator means mounted on the bag for manual displacement. The actuator means may be displaced in various ways, for example, by a folding- or a pull-type action. The forming means also includes bow means displaceable by the actuator means between a bow-unformed position and a bow-formed position. Means are further provided for securing the bow means in the bow-formed position.

In the case of a folding-type actuator means, a flap is manually unfoldable about a folding axis from a folded state to an unfolded state. The bow means has one bow end stationarily mounted on the article, and another bow end displaceable about the folding axis by the flap from the bow-unformed position in the folded state in which the flap covers and substantially conceals the bow means from view, to the bow-formed position in the unfolded state in which the flap uncovers and exposes the bow means to view.

In one embodiment, the flap, preferably planar, is mounted at and overlies one of the two opposing walls, e.g. the front wall, at one side of the bag. The flap extends at least partly along an upper marginal linear edge, and is of one piece with, the front wall. This upper linear edge is co-linear with the aforementioned folding axis.

In the bow-unformed position, the bow means is located between the front wall and the flap, and is substantially hidden from view. The stationary bow end is secured to an exterior surface of the front wall, and the displaceable bow end is secured to an inner surface of the flap. In the bow-formed position, the flap overlies the other opposing wall, e.g. the rear wall, at an opposite side of the bag. At the same time, the bow means extends over the closed opening, and is visible from all sides of the bag. In a preferred embodiment, the bow means assumes a generally circular configuration.

During the displacement of the flap about said upper linear edge, the bow means, in a preferred embodiment, is expanded and caused to extend along a circular path over the closed opening. In addition, the front and rear walls, which were in generally mutual parallelism in the bow-unformed state, remain so during and after said displacement to the bow-formed state so that the general configuration of the bag is not substantially altered.

The securing means, in a preferred embodiment, comprises an adhesive layer coated on an exterior surface of the flap, and a removable protective sheet overlying the adhesive layer, which is preferably a permanent-type adhesive. After removal of the protective sheet, preferably by peeling it off the adhesive layer, the adhesive layer permanently adheres the flap to an exterior surface of the rear wall. This insures that the bag will remain closed, thereby not only deterring theft, but also preventing the bow means from returning to its initial bow-unformed position. Hence, not only is a decorative bow capable of being formed rapidly by unskilled personnel with a minimum of fuss and bother, but also the complete package itself is an attractive gift package.

In another embodiment, the actuator means and the bow means together comprise a discrete assembly which is separately made from the article, and subsequently in use, attached to a surface thereof, for example, a wall of a bag. The assembly includes a pair of generally planar flaps hinged together along a common fold line extending along the folding axis for folding movement about the fold line between a closed collapsed state in which the flaps closely overlie each other, and an open unfolded state in which the flaps are moved away from each other. The bow means has one end secured to one flap, and an opposite end secured to the other flap. When the flaps are in the closed state, the bow means is collapsed between, and concealed by, the flaps. During the folding movement toward the open state, the bow means is successively opened to a greater and greater extent until, in the open state, the bow means is fully opened and exposed to view.

The assembly may be adhesively attached to the bag in the closed collapsed stat by the bag manufacturer, whereupon, the compact package is easy to ship. The retail clerk or gift giver may also attach the assembly to the bag. In any event, when it is desired to adorn the bag, the flap, which is not directly attached to the bag, is folded to the open state, whereupon, the bow means is displaced to its exposed condition.

It will be expressly understood that the twin flap and bow assembly need not be solely used in connection with adorning and simultaneously closing bags, containers or like packages, but can be used to adorn any article. For example, a book, a greeting card, or virtually any article can be rendered more attractive by affixing the novel twin flap and bow assembly thereon.

As previously mentioned, the actuator means can be displaceable by a pull-type action, in which case, the bow means is likewise formed by such a pulling action. In a preferred embodiment, the bow means is integral with the bag walls and comprises a plurality of elongated, crescent-shaped, bow elements formed at upper marginal portions of the bag. The bow elements are arranged in groups extending circumferentially around the upper opening of the bag about a longitudinal axis, as well as being stacked, one above another, along the longitudinal axis. Each bow element has opposite ends, and lies essentially flat in the bow-unformed state.

The actuator means includes a gathering loop extending circumferentially around, and threaded through slits formed in, the upper marginal portions of the bag about the upper opening, as well as a gripping portion extending from the bag and accessible to be grasped. Upon pulling the gripping portion away from the bag, the perimeter of the gathering loop grows smaller, eventually closing the upper opening. At the same time, the ends of each bow element are drawn toward each other, thereby forming individual loops which together form the decorative bow at the top of the bag and is visible in all directions.

In a variant of the last-mentioned construction, the formation of the bow need not simultaneously cause the upper marginal portions of the bag to be gathered. Instead, pulling on the gripping portion causes the gathering loop only to form the bow at the upper opening of the bag.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

BRIEF DESCRIPTION OF THE DRAWINGS

FIG. 5 is a view analogous to FIG. 4, but of a modification of the gift package;

FIG. 6 is a view analogous to FIG. 4, but of a different modification of the gift package;

FIG. 7 is a front perspective view of the twin flap and bow assembly of FIG. 5, as attached to a book;

FIG. 8 is a front perspective view of the twin flap and bow assembly of FIG. 5, as attached to a greeting card;

DETAILED DESCRIPTION OF THE PREFERRED EMBODIMENTS

Figure 1:
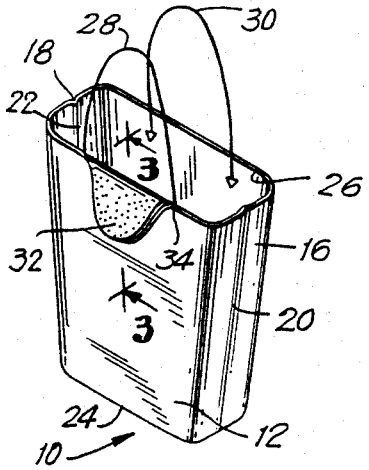
FIG. 1 is a front perspective view of a gift package in accordance with this invention, in an open
Figure 2:
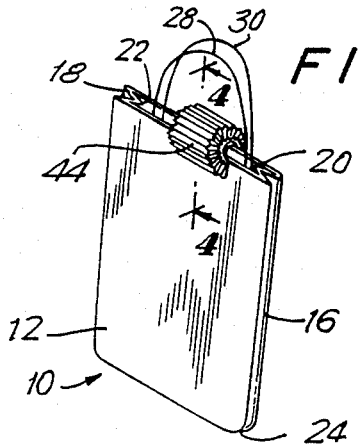
FIG. 2 is a front perspective view of the gift package of FIG. 1, in a closed state.

Referring now to the drawings, reference numeral 10 generally identifies a shopping bag of the expandable type. The bag 10 is shown in an open state in FIG. 1 and in a closed state in FIG. 2. Shopping bag 10 has walls, preferably of paper, bounding an interior for containing a gift or like object. Two of the walls consist of a front wall 12 and a rear wall 14 which oppose each other in a generally parallel relationship. The front and rear walls 12, 14 are movable away from each other to bound an upper opening 26 through which the object may pass, and are movable toward each other to close the opening 26. Additional bag walls include side walls 16 and 18 which extend between the front and rear walls, as well as a bottom wall 24 which closes the bottom of the bag. Side walls 16, 18 are formed with upright creases 20, 22, respectively, in central regions thereof. The creases extend along a longitudinal direction. The front and rear walls are movable in a transverse direction toward and away from each other generally perpendicular to said longitudinal direction.

A pair of carrying bails 28, 30 are attached in conventional manner to upper marginal regions of the front 12 and rear 14 walls of the bag. Each bail forms an opening through which one's hand may pass for carrying the bag. The shopping bag 10, as described so far, is entirely conventional in the art, and need not be made of paper, but can also be made of plastic material, fabric material, leather, vinyl, laminates, and virtually any other material, preferably limp, which is capable of supporting objects.

Figure 3:
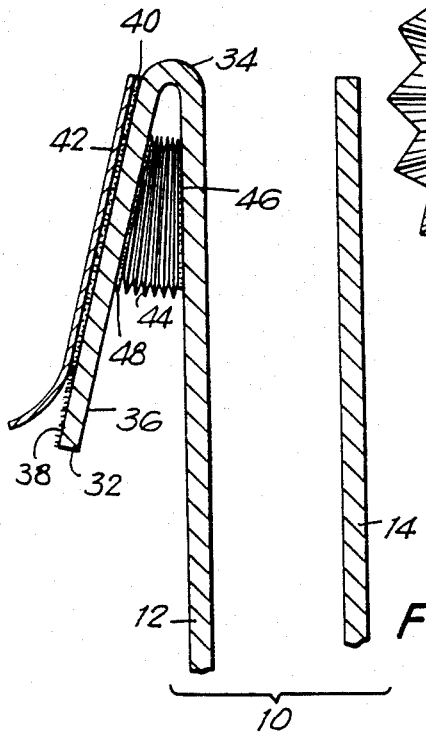
FIG. 3 is an enlarged sectional view taken on line 3—3 of FIG. 1.

In accordance with this invention, means are provided for closing the bag for not only resisting tampering, but also for simultaneously forming a decorative bow which is visible from all sides of the bag. Said means includes actuator means displaceable relative to the bag. In one embodiment, the actuator means is of the folding type, and includes a generally planar flap 32 pivotably mounted at, and normally overlying, one of the two opposing walls, e.g. front wall 12, at one side of the bag. The flap 32 extends at least partly along an upper marginal linear edge 34 of the front wall 12. The foldable flap 32, as best shown in FIG. 3, is of one-piece construction with front wall 12. Flap 32 has an interior surface 36 facing an exterior surface of front wall 12, and an opposite exterior surface 38 facing away from front wall 12. Flap 32 is pivotably displaceable about the upper linear edge 34 which extends along a folding axis from the folded position shown in FIG. 3 over the closed opening of the bag, to the unfolded position shown in FIG. 4 for a purpose to be explained below.

Figure 4:
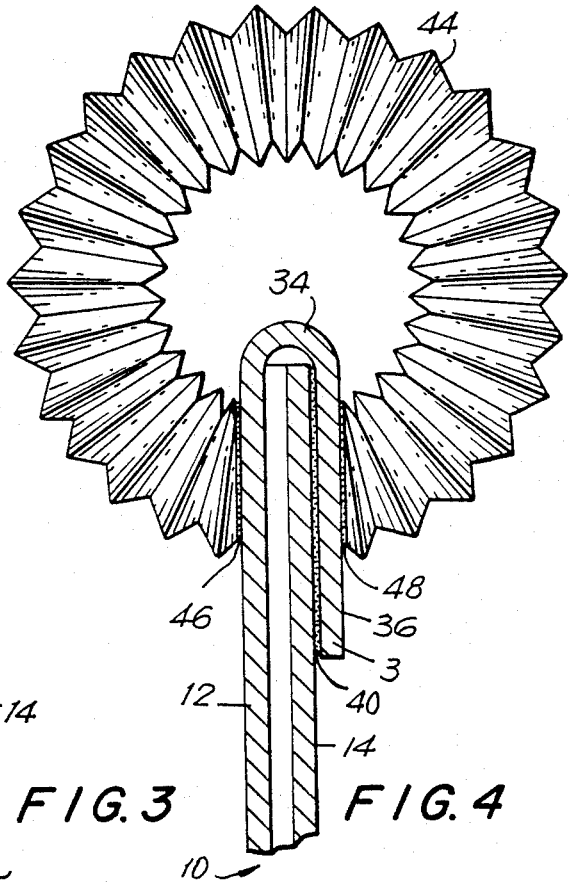
FIG. 4 is an enlarged sectional view taken on line 4—4 of FIG. 2.

The invention also includes means for fixedly securing the flap 32 in the FIG. 4 position and, for that purpose, an adhesive layer 40, preferably a permanent or aggressive adhesive, is coated on the exterior surface 38 of flap 32. A removable peel-off protective sheet 42 overlies the adhesive layer 40 and is peelable therefrom to expose the adhesive layer.

Bow means, including a collapsible/expandable bow 44, is operatively connected to the flap 32 and displaceable by the same. The bow 44, just like the flap 32, is mounted on the bag for displacement about said upper linear edge 34 over the closed top between a bow-concealed or bow-unformed position shown in FIG. 3 and a bow-exposed or bow-formed position shown in FIG. 4.

As best shown in FIG. 3, the collapsed bow 44 has one bow end 46 fixedly and stationarily secured to an upper marginal region of front wall 12. An opposite bow end 48 is fixedly secured to the interior surface 36 of flap 32. Due to the collapsed condition of bow 44 and its location between flap 32 and front wall 12, the bow 44 is substantially hidden from view.

During displacement of the flap 32 from the FIG. 3 to the FIG. 4 position, the collapsed bow 44 begins to unfold and expand in the manner of an opening accordion or bellows. The bow extends along a circular path through the openings in the bails over the closed opening of the bag.

Eventually, the flap 32 overlies an upper marginal region of rear wall 14. Once the protective sheet 42 has been removed to expose the adhesive layer 40, the flap 32 may now be adhered to the rear wall 14, thereby insuring that the opened bow 33 will not collapse and return to its initial collapsed condition. Hence, not only is the bag effectively closed and sealed, but also is adorned with an attractive bow which is visible from all sides of the bag.

As described so far, the flap 32 is of one piece with the front wall 12 and, hence, a standard shopping bag cannot be used. However, it is also within the scope of this invention to manufacture the actuator means and the bow means together as a discrete assembly which is made separately from, and to subsequently attach the assembly to, a standard shopping bag, i.e. one having no flap.

As shown in FIG. 5, the front wall 12 has no integral flap 32. Instead, the actuator means includes two flaps 50, 52 hinged at, and foldable about, fold line 54 which extends along a folding axis. The flaps may be coated with individual adhesive layers, or with a single continuous adhesive layer 56. A bellows- or accordion-like bow identical to bow 44 is mounted between the flaps, and is opened when the flaps are outfolded away from each other, and closed when the flaps are folded inwardly toward each other. Flap 50 can be adhered to front wall 12 by the retail clerk, or by the gift giver, merely by pressing the exposed adhesive on the flap 50 against the front wall 12. Preferably, the bag manufacturer could pre-glue the flap 50 to front wall 12. The discrete assembly comprised of a bow 44 and the two hinged flaps 50, 52 can be applied to any article requiring adornment, and not necessarily to a bag, box or like article in which a gift article is contained.

FIG. 6 illustrates a different assembly, again comprised of two flaps 50, 52 hinged along linear fold line 54 and adhered at adhesive layer 56 to front and rear walls 12, 14 of bag 10. However, rather than a bellows- or accordion-like bow, a bow 60 is secured to the flaps. Bow 60 includes a compressible spherical shell 62, preferably of elastomeric material, in which the inner ends of a plurality of elongated elements 64 are embedded. In the illustrated open or bow-exposed position, the elements 64 extend radially outwardly in a starburst-like configuration. In the closed or bow-concealed position, the flaps overlie one another; the shell 62 is compressed; and the elements lie in a closely stacked state.

In the above-described embodiments of the folding type, once one end of the bow, or one flap, is fixedly secured to one wall of the bag, the opposite flap is free to be pivotably displaced over the top of the bag about a linear folding axis until the opposite flap overlies and is fixedly secured to an opposite wall of the bag. The linear axis can be the upper linear edge 34 of a bag wall, or the fold line 54.

The bow can be made of many different designs, and is not intended to be restricted to the accordion- or bellows-type bow shown in FIGS. 4 and 5, or the starburst-like bow shown in FIG. 6. For example, the bow can be comprised of a plurality of folded-over loops arranged in a pompon, rosette, or other configuration. The bow can be comprised of a honeycomb design. Virtually any bow design is contemplated by this invention.

As previously noted, the assembly itself, as a separate structure, can adorn virtually any article. As shown in FIG. 7, in the case of a book, the FIG. 5 assembly comprised of twin flaps 50, 52 and bow 44 need not be used to span and close the top of a bag, but can be adhered onto a cover of book 70.

As shown in FIG. 8, the FIG. 5 assembly can be used to close a greeting card 71 having a front sheet 73 and a rear sheet 75. Flaps 50, 52 are adhered to sheets 73, 75, respectively, and the opened bow 44 spans the distance between the sheets 73, 75.

Figure 9:
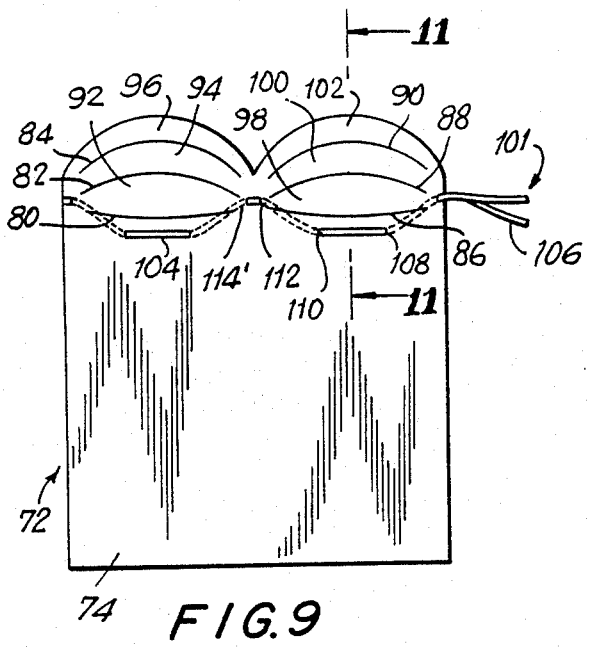
FIG. 9 is a front view of yet another modification of the gift package in an open state.
Figure 11:
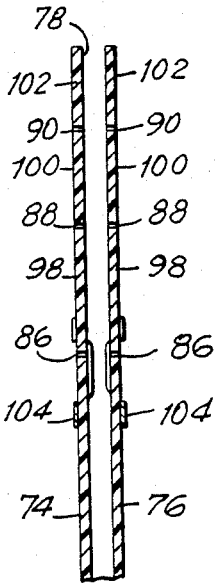
FIG. 11 is an enlarged sectional view taken on line 11—11 of FIG. 9.
Figure 10:
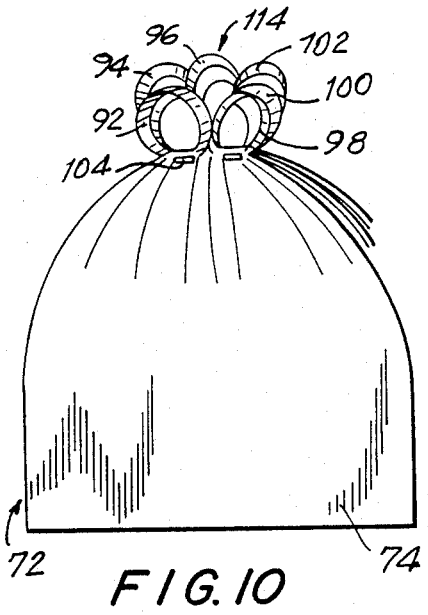
FIG. 10 is a front view of the gift package of FIG. 9 in a closed state.

Turning now to the embodiment of FIGS. 9–11, the actuator means is displaceable by a pulling action which, in turn, is used to form the decorative bow atop a bag 72. The bag 72 has a front wall 74 and a rear wall 76 bounding an upper opening 78. Upper marginal portions of the front and rear walls are formed with crescent-shaped, elongated bow elements which are integral with the front and rear walls. Each wall is cut along curved slits 80, 82, 84, 86, 88, 90 to form the bow elements 92, 94, 96, 98, 100, 102. The bow elements 92, 98 circumferentially surround in endwise manner the bag walls. Bow elements 94, 100 are stacked above elements 92, 98; and bow elements 96, 102 are stacked longitudinally above the elements 94, 100. More or fewer bow elements could be employed.

The pull-type actuator means is a drawstring 101 which is threaded through apertures cut into upper marginal portions of the bag to form a gathering loop 04 which extends circumferentially around the upper marginal portions of the bag, and a gripping or handle portion 106 which extends outwardly of the bag. The drawstring, as shown, is threaded through aperture 108 to the outside of the front wall 74, and then returned to the interior of the bag through aperture 110, and then threaded through aperture 112 to the outside of front wall 74, and then returned to the interior of the bag through aperture 114', and so on, around the circumference of the bag. The apertures serve as tube means through which the gathering loop is passed.

In this manner, when the handle portion 106 is grasped and pulled, the periphery of the gathering loop 104 gradually decreases to smaller sizes, eventually closing the upper opening 78 of the bag. At the same time, each bow element is folded about its middle to form a loop, since the in-and-out threading of the drawstring adjacent opposite ends of each bow element causes said ends to be drawn together, thereby forming the respective loop. All the so-formed loops together form a bow 114 shown in FIG. 10. Thus, in the unformed state, the bow elements lie essentially flat, whereas in the formed state, the bow elements form the bow 114.

It will be understood that each of the elements described above, or two or more together, also may find a useful application in other types of constructions differing from the types described above.

While the invention has been illustrated and described as embodied in a decorative gift package, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A decorative gift package, comprising:

(A) an article to be decorated;

(B) means on the article for forming a decorative bow visible from all sides of the article, including (i) actuator means manually positionable about an axis from a first to a second state, and (ii) bow means having one bow end stationarily mounted on the article, and another bow end displaceable about the axis by the actuator means from a bow-unformed position in the first state, to a bow-formed position in the second state in which the bow extends outwardly of the article and is visible from all sides of the article; and (C) means for securing the bow means in the bow-formed position.

2. The gift package as recited in claim 1, wherein the actuator means covers and substantially conceals the bow means from view in the bow-unformed position.

3. The gift package as recited in claim 2, wherein the article is a container having two walls; and wherein the actuator means includes a flap which overlies one of the walls and the bow means in the bow-unformed position, and which overlies the other of the walls in the bow-formed position.

4. The gift package as recited in claim 3, wherein the two walls oppose, and are movable relative to, each other; and wherein the two walls bound an opening which is closed upon movement of the two walls toward each other.

5. The gift package as recited in claim 4, wherein the forming means is simultaneously operative for closing the opening, said flap being operatively connected to said other bow end for joint movement therewith, and being positioned about said axis to displace said other bow end over the closed opening.

6. The gift package as recited in claim 5, wherein the article is a shopping bag bounding an interior for containing an object, said bag having a carrying bail on each of said two opposing walls, each bail forming a bail opening; and wherein the flap and said other bow end are displaced along a path which extends through each bail opening.

7. The gift package as recited in claim 6, wherein the bag includes a pair of side walls extending between the two opposing walls, said side walls having upright creases extending along a longitudinal direction, said two opposing walls being movable in a transverse direction generally perpendicular to said longitudinal direction.

8. The gift package as recited in claim 1, wherein the actuator means is integral with the article.

9. The gift package as recited in claim 8, wherein the article includes a wall having an upper marginal linear edge, and wherein the actuator means includes a flap of one piece with said wall along the upper marginal linear edge of said wall, said upper edge being co-linear with said axis.

10. The gift package as recited in claim 1, wherein the article includes a wall having an exterior surface, and wherein the actuator means includes a flap having an inner generally planar surface facing the exterior surface of said wall in the bow-unformed position, and wherein said one bow end is secured to said exterior surface of said wall, and said other bow end is secured to said inner surface of the flap.

11. The gift package as recited in claim 1, wherein the bow means and the actuator means constitute an integral assembly initially discrete from, and in use attachable to, the article.

12. The gift package as recited in claim 11, wherein the actuator means includes a pair of generally planar flaps hinged together, and pivotable about, the axis, said bow ends being respectively secured to said flaps.

13. The gift package as recited in claim 1, wherein the bow means includes a collapsible/expandable bellows-type bow which has a collapsed configuration in the bow-unformed position, and an expanded configuration in the bow-formed position.

14. The gift package as recited in claim 5, wherein the bow means extends along a circular path over the closed opening in the bow-formed position.

15. The gift package as recited in claim 12, wherein the bow means includes an elastomeric shell having opposite ends respectively secured to the flaps, and a plurality of elongated elements having first ends connected to the shell, and second ends remote from the shell.

16. The gift package as recited in claim 15, wherein the bow means has a collapsed configuration in the bow-unformed position, and a generally radial, star-burst-like, expanded configuration in the bow-formed position.

17. The gift package as recited in claim 1, wherein the actuator means includes a flap having an exterior generally planar surface, and wherein the securing means includes an adhesive layer coated on the exterior generally planar surface of the flap, and a removable protective sheet peelably overlying the adhesive layer.

18. The gift package as recited in claim 17, wherein the adhesive layer, after removal of the protective sheet, adheres the flap to the article in the bow-formed position.

19. A decorative gift package, comprising:

(A) a bag having movable walls bounding an interior and an upper opening which is closed upon movement of the walls toward each other;

(B) means on the bag for forming a decorative bow at the closed opening, including (i) actuator means mounted on the bag for manual displacement, and (ii) bow means mounted on and displaceable by the actuator means between a bow-unformed position and a bow-formed position in which the bow extends above the closed opening and is visible from all sides of the bag; and (C) means for securing the bow means in the bow-formed position.

20. The gift package as recited in claim 19, wherein the actuator means includes a flap mounted on the bag for pivoting movement about axis between a first state in which the flap covers and substantially conceals the bow means, and a second state in which the bow means is exposed to view.

21. The gift package as recited in claim 20, wherein the flap is integral with one of the walls of the bag and is hinged along an upper marginal linear edge of said one wall, said upper marginal linear edge being co-linear with the axis.

22. The gift package as recited in clam 20, wherein the flap is hinged along a line to another flap, said line extending along the axis, and wherein the bow means is secured between the flaps.

23. The gift package as recited in claim 19, wherein the bow means includes a plurality of elongated bow elements each having opposite bow ends, said bow elements being integral with the walls of the bag, and wherein the actuator means includes a gathering loop extending circumferentially around upper marginal portions of the bag, and a pull-type gripping portion operative, when pulled, to urge the bow ends of each bow element to move toward each other and form individual bow loops which together form the decorative bow.

24. The gift package as recited in claim 23, wherein the gripping portion is also operative to gather the upper marginal portions of the bag toward each other to close the opening simultaneously with the formation of the bow.

25. The gift package as recited in claim 24, wherein the upper marginal portions of the bag include tube means through which the gathering loop is threaded.

26. The gift package as recited in claim 25, wherein a first group of said plurality of bow elements extends circumferentially around the opening about a longitudinal axis, and wherein additional groups of said bow elements are stacked, one above another, along the longitudinal axis.

27. The gift package as recited in claim 26, wherein each bow element has a crescent shape in the bow-unformed position, and wherein the actuator means is a drawstring-type ribbon.

28. A decorative gift package, comprising:

(A) a bag having movable walls bounding an interior and an upper opening which is closed upon movement of the walls toward each other;

(B) means on the bag for forming a decorative bow at the closed opening, including (i) actuator means mounted on the bag for manual displacement, and (ii) bow means displaceable by the actuator means between a bow-unformed position and a bow-formed position in which the bow extends above the closed opening and is visible from all sides of the bag, said bow means including a plurality of elongated bow elements each having opposite bow ends, said bow elements being integral with the walls of the bag, (iii) said actuator means including a pull-type gripping portion operative, when pulled, to urge the bow ends of each bow element to move toward each other and form individual bow loops which together form the decorative bow; and (C) means for securing the decorative bow in the bow-formed position.

29. A decorative gift package, comprising:

(A) an article to be decorated;

(B) means on the article for forming a decoration visible from all sides of the article, including (i) mounting means manually displaceable about an axis from an undisplaced to a displaced state, (ii) decoration means mounted on the mounting means, and jointly displaceable about the axis with the mounting means from first position in the undisplaced state, to a second position in the displaced state in which the decoration extends outwardly of the article and is visible from all sides of the article; and (C) means for securing the decoration means in the second position.

* * * * *